US006282814B1

(12) United States Patent
Krafsur et al.

(10) Patent No.: US 6,282,814 B1
(45) Date of Patent: Sep. 4, 2001

(54) SPRING CUSHIONED SHOE

(75) Inventors: David S. Krafsur, Lenoir City; Francis E. LeVert, Knoxville, both of TN (US)

(73) Assignee: Shoe Spring, Inc., Lenoir City, TN (US)

( * ) Notice: Subject to any disclaimer, the term of this patent is extended or adjusted under 35 U.S.C. 154(b) by 0 days.

(21) Appl. No.: 09/419,330

(22) Filed: Oct. 15, 1999

Related U.S. Application Data

(60) Provisional application No. 60/131,658, filed on Apr. 29, 1999.

(51) Int. Cl.[7] ..... A43B 13/28
(52) U.S. Cl. ..... 36/27; 36/38
(58) Field of Search ..... 36/7.8, 27, 28, 36/38

(56) References Cited

U.S. PATENT DOCUMENTS

| | | | |
|---|---|---|---|
| 1,502,087 | 7/1924 | Bunns . | |
| 2,444,865 | 7/1948 | Warrington . | |
| 2,447,603 | 8/1948 | Snyder . | |
| 2,668,374 | 2/1954 | Seigle . | |
| 2,669,038 | 2/1954 | De Werth . | |
| 3,822,490 | 7/1974 | Murawski | 36/2.5 R |
| 4,267,648 | 5/1981 | Weisz . | |
| 4,492,046 | 1/1985 | Kosova | 36/27 |
| 4,592,153 | 6/1986 | Jacinto | 36/38 |
| 4,815,221 | 3/1989 | Diaz | 36/27 |
| 4,901,987 * | 2/1990 | Greenhill et al. . | |
| 5,269,081 | 12/1993 | Gray | 36/136 |
| 5,337,492 | 8/1994 | Anderie et al. . | |
| 5,343,636 | 9/1994 | Sabol | 36/78 |
| 5,435,079 | 7/1995 | Gallegos | 36/38 |
| 5,437,110 | 8/1995 | Goldston et al. | 36/38 |
| 5,502,901 | 4/1996 | Brown | 36/28 |
| 5,511,324 | 4/1996 | Smith | 36/27 |
| 5,517,769 | 5/1996 | Zhao | 36/27 |
| 5,544,431 | 8/1996 | Dixon | 36/38 |
| 5,639,074 | 6/1997 | Greenhill et al. | 267/162 |
| 5,743,028 | 4/1998 | Lombardino | 36/27 |
| 5,875,567 | 3/1999 | Bayley | 36/27 |
| 5,896,679 | 4/1999 | Baldwin | 36/27 |
| 5,916,071 | 6/1999 | Lee | 482/77 |
| 6,006,449 * | 12/1999 | Orlowski et al. . | |

* cited by examiner

*Primary Examiner*—Ted Kavanaugh
(74) *Attorney, Agent, or Firm*—Fish & Richardson P.C.

(57) ABSTRACT

A spring cushioned shoe is disclosed. The shoe includes a sole assembly that has a first spring disposed within a vacuity in the heel portion of the assembly, and a second spring disposed within a vacuity in the ball portion of the assembly. The springs are, e.g., wave springs that extend vertically from the upper to the lower internal boundaries of the vacuities.

9 Claims, 4 Drawing Sheets

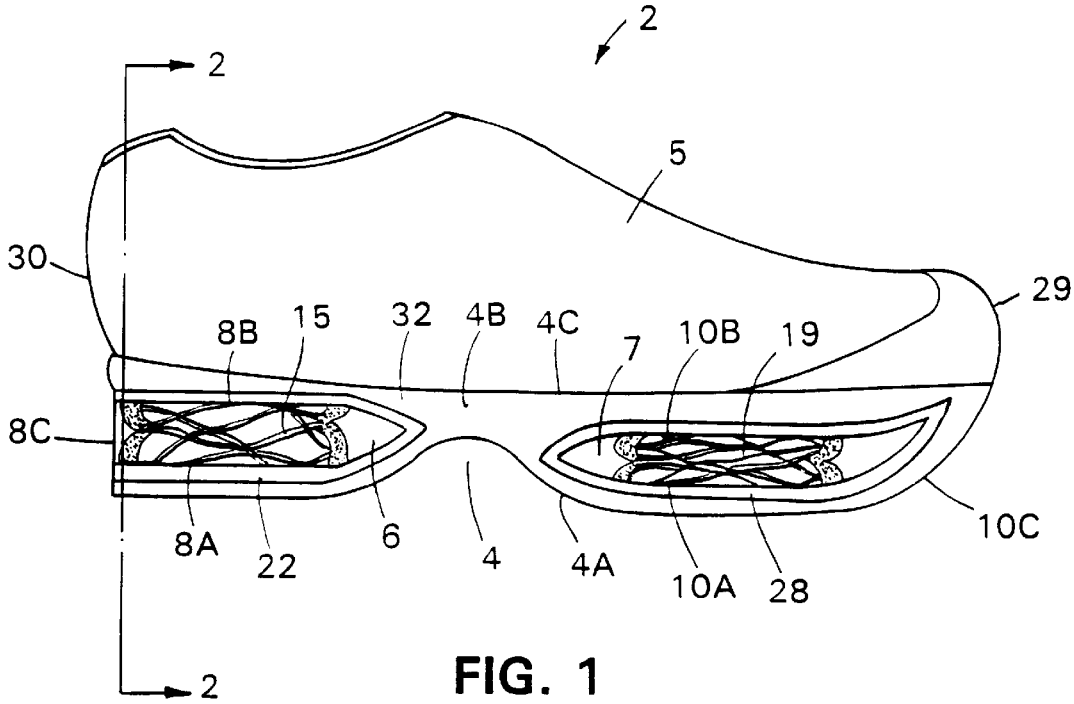
FIG. 1
FIG. 2
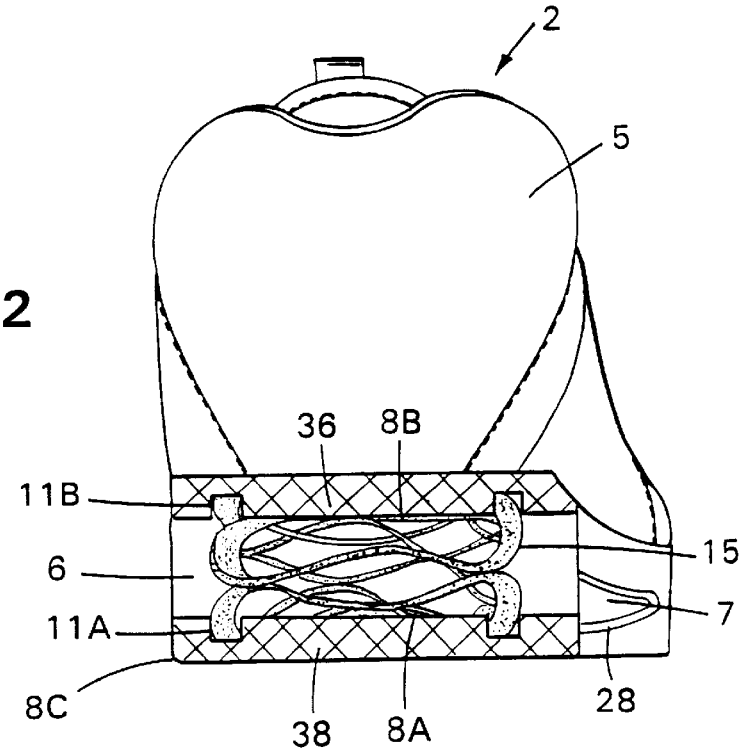

SPRING CUSHIONED SHOE

CROSS-REFERENCE OF RELATED APPLICATIONS

Pursuant to 35 U.S.C. Section 119, the benefit of priority from Provisional Application Ser. No. 60/131,658 with a filing date of Apr. 29, 1999 is claimed for this Non-Provisional Application.

BACKGROUND OF THE INVENTION

1. Technical Field

This invention relates to the use of wave springs to cushion a shoe. Wave springs allow for reduced impact on the user during foot strike, thus increasing comfort and decreasing injury. Also, the wave springs will return a portion of the impact energy to the user for more efficient jumping, walking and/or running.

2. Background Art

People involved in normal exercise programs are always seeking new equipment that can minimize the risk of injury to parts of the body caused by stress due to a foot strike. Athletes are also continually looking for ways to improve their performance levels in a variety of athletic and aerobic events that involve walking, running, or jumping while at the same time, taking steps to reduce the wear and tear attendant to the pounding endured by joints and bones. This can be achieved to some degree by the use of improved sporting equipment and more specifically improved shoes for both athletes and non-athletes.

When participating in sports, especially high impact sports such as volleyball and basketball, the foot of the participant; specifically the ball and heel areas are prone to extreme mechanical stress due to the force that will be imparted when the foot strikes a relative incompressible surface. This force, which will vary depending on the type of event that a person is involved in and the mass of the person, can be as large as five times the body weight of the participant. The reaction force resulting from contact with a non-yielding surface causes great shock to the body that can injure the lower back and all rotating joints of the leg.

Unlike events that involve jumping, the mechanics of running or walking involve a prescribed set of motions insofar as the foot is concerned. Except in those events that involve sprinting, the heel impacts the ground first, the weight then shifts forward onto the ball of the foot in a rolling manner with the toe region providing the last contact with the ground. The initial impact in the heel area is of special interest with non-sprinting runners because; it is here that landing forces come into play. It is desirable to absorb as much impact energy as possible, consistent with providing a stable landing and without slowing down the runner. It is also desirable to avoid the complete loss of energy absorbed by the shoe at impact. Also, since the ball and toe areas of the foot are the last to leave the surface in contact with the ground, it is desirable to recover some of the landing energy absorbed in the initial impact. A number of patents relate to shoe constructions, which are variously designed to address one or more of the desirable shoe features discussed above, are reviewed below:

U.S. Pat. No. 5,896,679 discloses an article of footwear with a spring mechanism located in the heel area of a shoe including two plates connected one to the other and attachment to the lower surface of the shoe sole. The invention of the '679 patent provides a heel mechanism that absorbs the shock or impact foot strikes. U. S. Pat. No. 5,743,028 (T. D. Lombardino) discloses a plurality of vertically compression springs located in the heel area of a running shoe. The springs of the '028 patent are housed in a hermetically sealed unit filled with a pressurized gas which in combination with the springs provides a shock absorbing and energy return system. The springs having substantially a coiled appearance where each spiral coil must provide a torsional spring force and collapse in a vertical stack commonly called the solid height when totally compressed. Because of their design, these springs must have significant free heights to accord one with large deflections. U.S. Pat. No. 4,815,221, Diaz discloses an energy control system comprising a spring plate having a plurality of spring projections distributed over the surface of the plate which is placed in a vacuity formed within the mid-sole of an athletic shoe. U.S. Pat. No. 5,511,324 (R. Smith) discloses a shoe in which a coil spring extends from the top through the wedge sole in the heel area of an athletic shoe. U.S. Pat. No. 5,437,110 (Goldston et al.) discloses an adjustable shoe heel spring and stabilizer device for a running shoe including a spring mechanism disposed in the mid-sole of the shoe. The shoe heel spring includes a cantilevered spring member and an adjustable fulcrum. A shoe designed specifically for jumping is disclosed in U.S. Pat. No. 5,916,071 (Y. Y. Lee). Lee discloses a shoe mounted on a frame containing a coil spring that extends horizontally from the regions of the frame located at the toe and heel areas of the shoe which expands and contracts during walking and jumping. U.S. Pat. No. 4,492,046 (Kosova) discloses a running shoe which includes a spring wire located in a longitudinal slot in the shoe sole extending from the back edge thereof into the arch region. U.S. Pat. No. 2,447,603 (Snyder) discloses a U-shaped spring plate disposed between the heel of the shoe and overlying a rear portion of the shoe sole. Several other U.S. patents of related art are: U.S. Pat. No. 5,875,567 (R. Bayley); U.S. Pat. No. 5,269,081 (Gray); U.S. Pat. No. 2,444,865 (Warrington); U.S. Pat. No. 3,822,490 (Murawski); U.S. Pat. No. 4,592,153 (Jacinta); and, U.S. Pat. No. 5,343,636 (Sabol); U.S. Pat. No. 5,435,079 (Gallegos); U.S. Pat. No. 5,502,901 (Brown); U.S. Pat. No. 5,517,769 (Zhao); and U.S. Pat. No. 5,544,431 (Dixon).

Revisiting and expanding the above mentioned desirable attributes of a shoe of this type, there is a need for a shoe that enhances the performance of the wearer by providing a substantial spring force working through a significant distance while requiring a minimum volume for deployment. In addition there is a need for a shoe designed with a multiplicity of springs that also assists in propelling the foot off the ground while still maintaining sufficient lateral stability of the shoe for quick side-to-side movement of the wearer. This performance enhancement can be achieved by temporarily storing the shock energy imparted by foot strike and returning a substantial amount of the energy to the wearer's foot during the propelling-off portion of the stride. Also, there is a need to assure adequate spring fatigue life by limiting maximum stresses and preventing compression to the spring's solid height.

The prior art cited above has disclosed spring devices in athletic shoes for the purposes of absorbing shock and returning energy to the wearer's foot.

As can be seen from the background art, there have been many attempts to add spring cushioning to shoes. However, one only need to look at the current market to see that spring cushioned shoes are not commonly available.

Accordingly, it is an object of this invention to provide a spring-cushioned shoe that provides large heel deceleration and ball acceleration during the foot strike.

A second object of this invention is to provide a shoe with a multiplicity of springs located at the heel and ball regions of the foot.

A third object of this invention is to provide a shoe that returns, by way of the spring force, a substantial energy stored in the springs during the initial compression cycle-of the heel or ball area of the foot.

A further object is to provide a shoe with maximum force and deflection within a minimal volume, as well as lateral stability. Other objects of this invention will become obvious during the review of the figures and the detailed description of the shoes of this invention.

BRIEF SUMMARY OF THE INVENTION

The present invention provides cushioning for a shoe that utilizes wave springs that are placed in the ball and heel areas of the sole of a shoe. It should be obvious to one skilled in the art that the placement of the wave springs is not limited to only the ball and heel areas of the shoe. In the present invention, the middle portion sole of the shoe sole assembly is made of foam with vacuities located at or near the ball and heel regions of the foot in order to accommodate placement of the springs. There are also numerous other methods and designs to place the wave springs into a shoe for cushioning and energy return. The ensuing description of the present invention discloses only a limited number of the countless methods and variations thereof that may be used. The advantages of the present invention will become apparent from reading the description of the invention in the preferred embodiments given below.

BRIEF DESCRIPTION OF THE DRAWINGS

FIG. 1 illustrates a side view of the preferred embodiment of the spring-cushioned shoe.

FIG. 2 illustrates a cross sectional view of the spring-cushioned shoe taken in the heel region of the spring cushioned shoe.

DETAILED DESCRIPTION OF THE PREFFERED EMBODIMENTS

Figure 3:
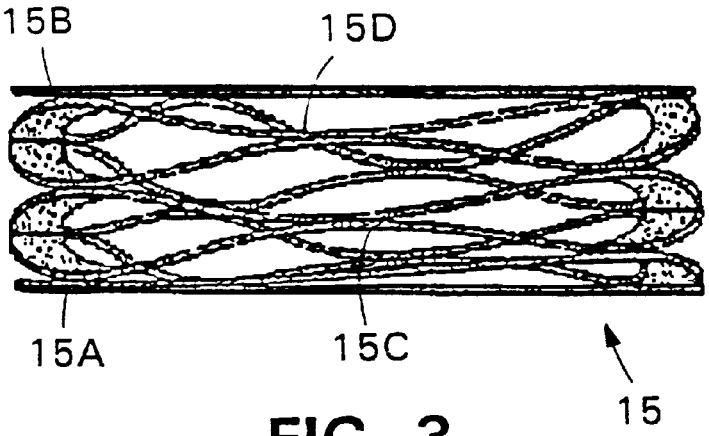
FIG. 3 illustrates a view of the wave spring component of the preferred embodiment

This invention relates to the use of ordinary compression springs as an integral part of shoes to cushion the impact of foot strikes and to provide recuperative energy return to the wearer. A spring-cushioned shoe incorporating the various features of the present invention is illustrated generally at 2 in FIGS. 1 and 2. The spring-cushioned shoe 2 shall hereafter be referred to as SCS 2.

The SCS 2 in FIG. 1 comprises: an upper shoe portion 5 firmly attached to shoe sole assembly 4. The shoe sole assembly 4 includes an outer sole 4A with first and second surfaces; middle sole 4B having first and second surfaces positioned such that its first surface is adhesively attached to the second surface of outer sole 4A; and, inner sole 4C whose first surface is adhesively attached to the second surface of middle sole 4B and whose second surface is in working contact with the lower region of upper shoe portion 5. In the present invention, the middle sole 4B is composed of foamed polymeric material, and the inner and outer soles 4A and 4C are made of solid polymeric materials. Particularly, the outer sole 4A is composed of ethyl vinyl acetate with the first surface of outer sole 4A having tractive characteristics. As shown in FIG. 1, the middle sole 4B is designed to include vacuities 6 and 7. Vacuity 6, the extent of which is defined by vertically opposing surfaces 8A and 8B of foamed polymeric material of middle sole assembly 4B, was formed in the heel region 8C of SCS 2. The surfaces 8A and 8B which are set apart from the second and first surfaces of middle sole 4B, respectively, define thick sections of middle sole 4B at the heel area of the shoe sole assembly 4 into which cylindrical countersunk volumes 11A and 11B, respectively are formed as shown in FIG.2. Vacuity 7 is disposed between vertically opposing surfaces 10A and 10B of foamed polymeric material 4B in the region 10C of shoe sole assembly 4. Like surfaces 8A and 8B, surfaces 10A and 10B define thick sections of the polymeric material of middle sole 4B located below and above the vacuity 7 in the vertical direction such that cylindrical countersunk volumes 16*a* and 16*b*(not shown in either FIG. 1 or 2) can be formed therein. The cylindrical countersunk volumes 11A and 11B and 16A and 16B provide vertical stabilization and retention of the wave springs 15 and 19. The shoe sole assembly 4 is firmly attached to upper portion 5 of SCS 2. Wave springs 15 and 19 are deployed in vacuities 6 and 7 of foamed polymeric material 4B of shoe sole assembly 4, respectively.

The wave springs 15 and 19 are substantially identical to wave springs described by Greenhill in U.S. Pat. No. 4,901,987. Greenhill describes a multi turn compression spring with distinct crests and troughs. A separate drawing of the wave spring 15 is presented in FIG. 3 for illustrative purposes. Wave spring 15 with circular flat shim ends 15A and 15B and wave crest 15C and wave trough 15D with prescribed periodicity are shown in FIG. 3. FIG. 3 illustrates the configuration of wave springs, 15 and 19 which provide for operationally acceptable force and deflection for a given free height of the springs. The compression wave springs of the preferred embodiment of this invention could be replaced with multi turn wave springs which do not employ flat shim ends but rather rely on the use of flat end plates in combination with ordinary wave springs.

The cylindrical countersunk volumes 11A and 11B are designed for slidably accepting the first and second shim ends 15A and 15B of wave spring 15, respectively, in heel region 8C. When fully inserted, the flat shim ends 15A and 15B of wave spring 15 are held in firm mechanical contact with the closed ends of cylindrical countersunk volumes 11A and 11B, respectively.

Figure 4:
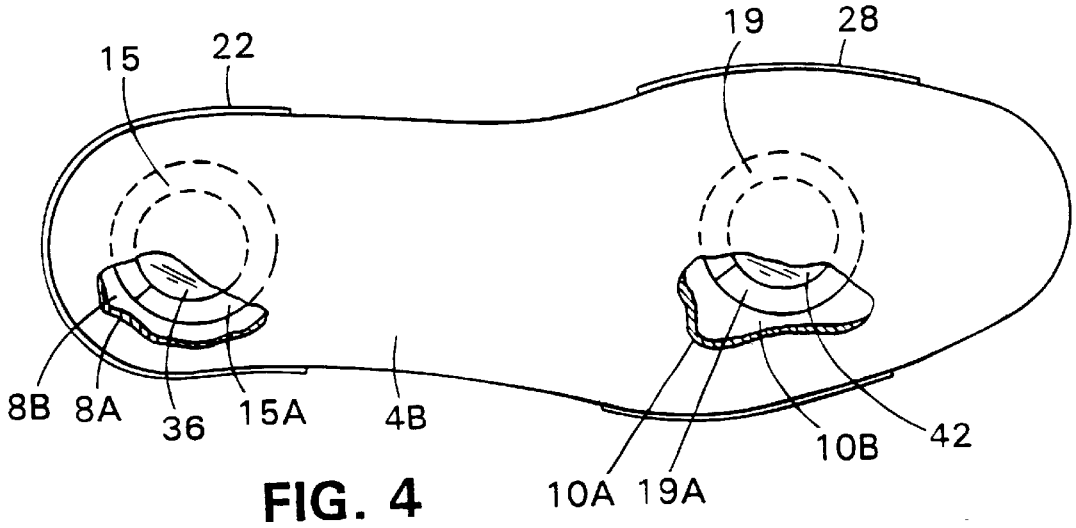
FIG. 4 illustrates a plan view of the outer sole of the spring-cushioned shoe.

The region of shoe sole assembly 4 of the SCS 2 that is normally proximate the metatarsal region of the foot likewise having surfaces 10A and 10B (see FIGS. 1 and 4) containing counter sunk cylindrical volumes 16*a* and 16*b* (not shown) for slidably accepting in the following order the first shim end 19A and the second shim end 19B (not shown), respectively, of wave spring 19. When fully inserted the shim ends 19A and 19B of wave springs 19 are in mechanical contact with the closed end portions of cylindrical volumes 16*a* and 16*b,* respectively. The surfaces 8A and 8B are mechanically held in a manner so as to provide minimal compressive loading on the shim ends 15A and 15B of wave spring 15 by transparent strip 22 (see FIG. 4) which is connected thereto by adhesive. Similarly, transparent Strip 28 (see FIG. 4) when adhesively attached to the surfaces 10A and 10B, provide a slight compressive load on shim ends 19A and 19B of wave spring 19. In addition to sealing vacuities 6 and 7 from the environment, strips 22 and 28 provide some lateral stability for the users of the SCS 2. It should be apparent that the strips 22 and 28 could also be made from a number of various materials. In FIG. 1, the upper portion 5 of the SCS 2 is made of high strength synthetic fabric. The materials that comprise the SCS 2 are not limited to only those mentioned in this disclosure. Any number of materials can be used in the manufacturing of the shoes of this invention. The cylindrical volumes 11A and 11B and 16*a* and 16*b* along with transparent strips 22 and 28 provide for retention and vertical stabilization of the wave springs 15 and 19 when they are inserted into vacuities 6 and 7 respectively.

Referring to FIG. 1, the front end 29, rear end 30 and middle region 32 of the shoe sole assembly 4 of the SCS 2 can be designed to provide retentive support for wave springs 15 and 19 that augments support provided by transparent strips 22 and 28. Such retentive support can consist of strips that connect the shoe sole assembly 4 to the upper shoe portion 5. In FIG. 1, wave springs 15 and 19 are shown as deployed in vacuities 6 and 7 in shoe sole assembly 4 which is attached to shoe upper portion 5. The cross sectional view in FIG. 2 shows interior wave spring compression limiters 36 and 38 which are integral parts of cylindrical countersunk volumes 11A and 11B respectively. That is, the compression limiter's outer dimensions define the inner diameters of countersunk volumes 11A and 11B, respectively.

The opposing spring compression limiters 36 and 38 (see FIGS. 2 and 4 ) are separated by extended waves spring 15 whose solid height when fully compressed by the strike force of the foot of a user is less than the linear distance in the vertical direction between spring compression limiters 36 and 38. The heights of compression limiters 36 and 38 are prescribed by the depth of the countersunk cylindrical volumes 11A and 11B in surfaces 8A and 8B, respectively. In the shoes of the present invention, the distance between the terminal ends of compression limiters 36 and 38 were set at 12 mm. The heights of spring compression limiters 36 and 38 are related mathematically to the spring constant of the wave spring and the mass of the user and are chosen such that the wave spring 15 can not be compressed to its solid height during use. Accordingly, because of the force generated at the portion of shoe sole assembly 4 of the SCS 2 that is normally proximate the metatarsal of the foot during normal use, the distance between the terminal ends of spring compression limiters 42 and 44 is set at 9 mm. The distance between spring compression limiters 42 and 44 (not shown) and the spring constant of wave spring 19 were selected such that the force generated, when the first surface of shoe sole assembly 4 opposite the ball of the foot contacts a surface while running, cannot compress wave spring 19 to its solid height.

It should be obvious to one skilled in the art that, depending on the weight of the user, the prescribed distances between the terminal ends spring compression limiters 36 and 38 as well as 42 and 44 will vary. In the present invention, the vacuities 6 and 7 of shoe sole assembly 4 were formed by splitting middle sole 4B into two substantially equal slabs forwardly from the heel area toward the toe of the shoe. The cylindrical countersunk volumes 11A and 11B and 16*a* and 16*b* were formed by machining, at the proper locations and depths in foam polymeric material of middle sole 4B. The combined depths of cylindrical countersunk volumes 11A and 11B and 16*a* and 16*b* were selected such that the heights of wave springs 15 and 19 would create vacuities 6 and 7 at those regions of 4B, when inserted therein. Once wave springs 15 and 19 were inserted in the machined cylindrical countersunk volumes, the split portions of foamed polymeric material of middle sole 4B were adhesively reattached at the middle region of shoe sole assembly 4. And, the vacuities 6 and 7 are sealed by strips 22 and 28 respectively. The strips 22 and 28 were attached by adhesive to the shoe sole assembly 4 at the heel and ball of the foot regions of the SCS 2. The foamed polymeric material of middle sole 4B could be made from any number of materials such as polyurethane.

The method for forming the vacuities 6 and 7 and fixing the wave springs 15 and 19 in the middle sole 4B of SCS 2 in the present invention was as discussed above. However, it is obvious to one skilled in the art that the vacuities and spring retention methods could be formed by any number of manufacturing techniques available to the shoe industry such as the use of the molding process and the springs inserted into the assembled shoe sole. Or the complete shoe sole—spring assembly could be made in one single continuous process.

The wave spring 15 which primarily provides cushioning during foot strikes has a free height selected to be greater than that of wave spring 19 which provides primarily liftoff force to the foot of a wearer.

Even though the wave springs 15 and 19 used in the shoes of this invention are metallic in construction, it should be obvious to one skilled in the art that the material of the wave springs is not solely limited to metals and that a wide variety of other materials could be used as well. Likewise, the materials used in the other parts of the shoe may be made from any multitude of materials commonly used in the art. While the shoe of this invention use single leaf crest-to-crest wave springs, it could have employed interlaced wave springs described in U.S. Pat. No. 5,639,074 or commercially available nested wave springs. The interlaced and nested wave springs like the crest-to-crest wave springs provide the primary desirable characteristics of crest-to-crest wave springs important to the shoe of the invention. That is, like crest-to-crest wave springs, interlaced and nested wave springs provide maximum force and deflection for a given unloaded spring height.

Figure 7:
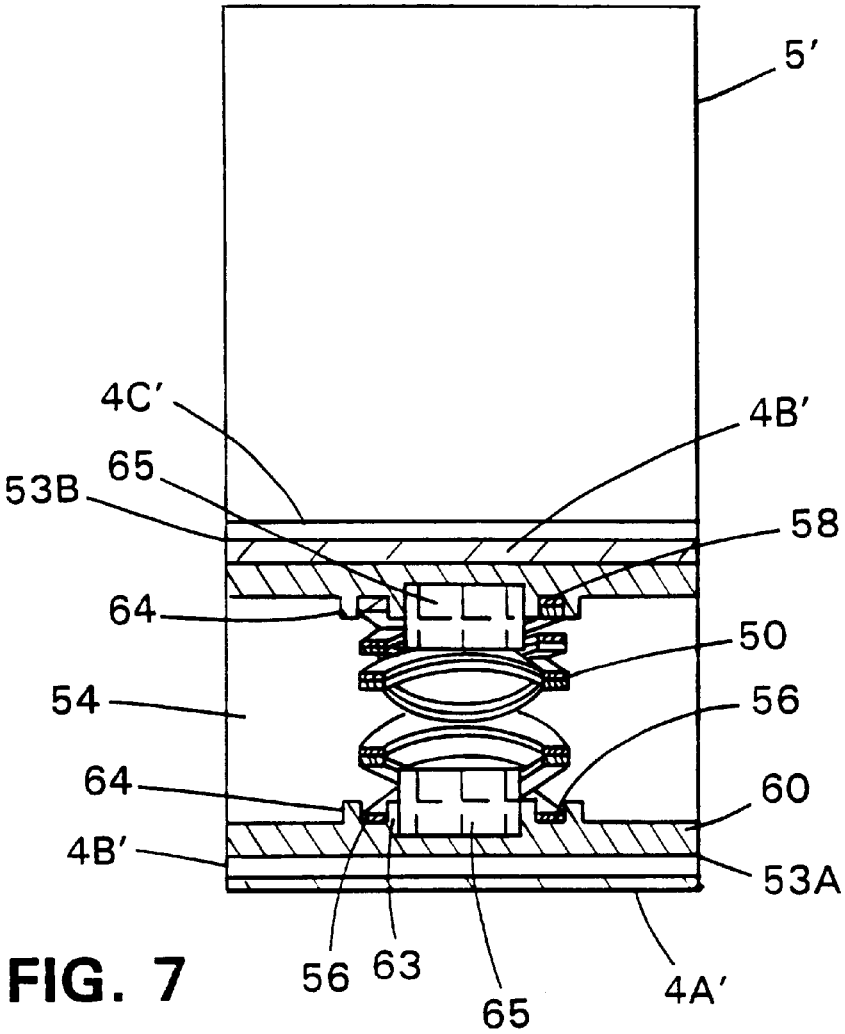
FIG. 7 illustrates a sectional view of one of the spring assemblies of the second embodiment of the spring-cushioned shoe with stabilizer and compression limiter.
Figure 6:
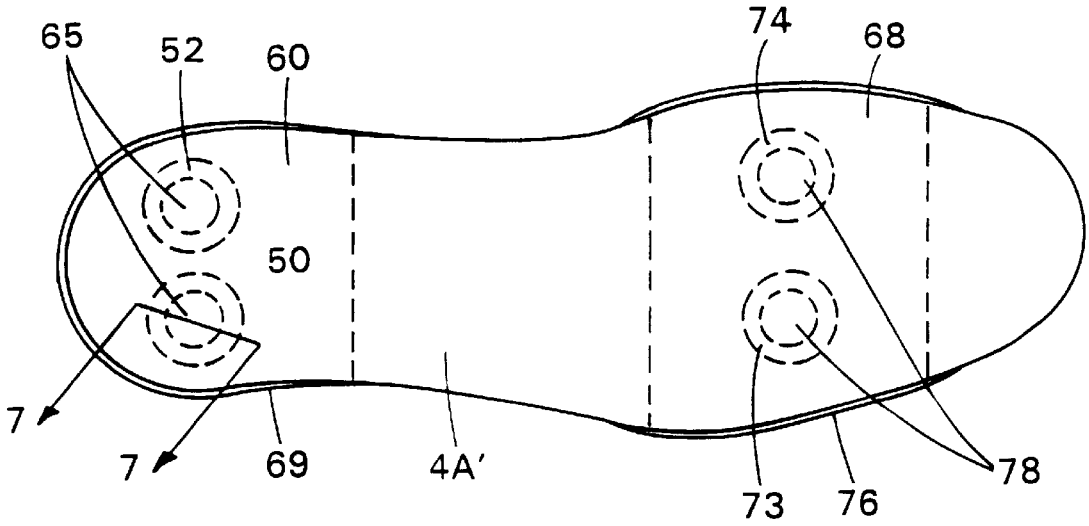
FIG. 6 illustrates a plan view of the outer sole of the second embodiment of the spring-cushioned shoe.
Figure 5:
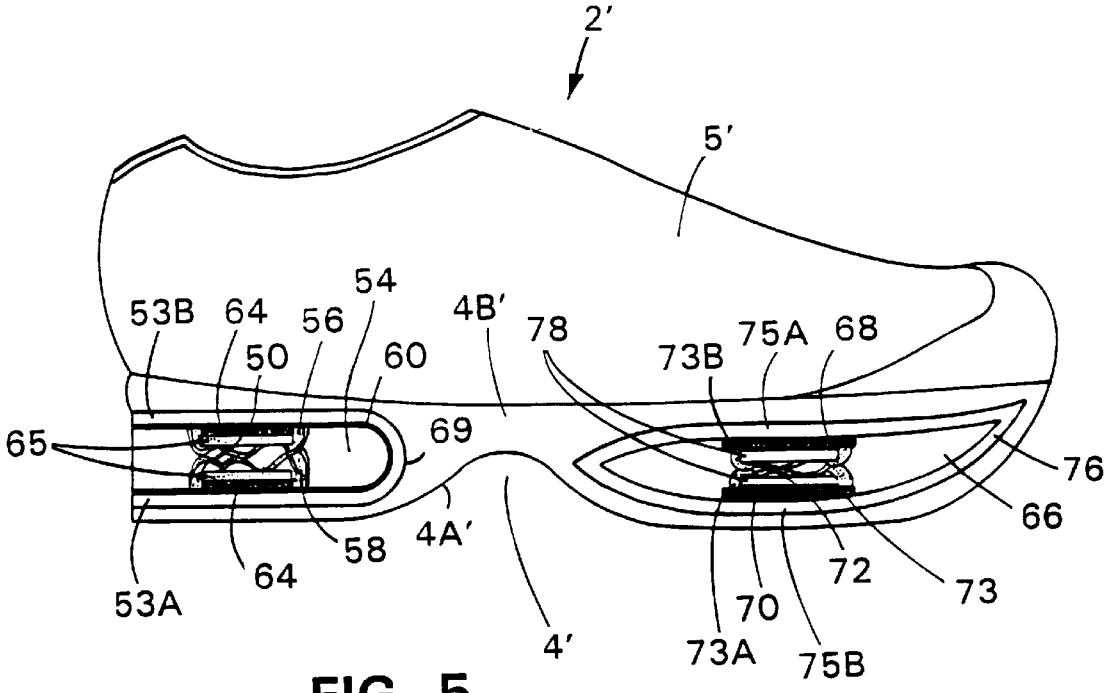
FIG. 5 illustrates a side view of the second embodiment of the spring cushioned shoe.

FIG. 5 shows a second embodiment of the shoes of this invention. In FIGS. 5 and 6, wave springs 50 and 52 are mounted in vacuity 54 with their first and second terminal shim ends 56 and 58 mounted in U-shaped plastic receiving clip 60, which contain protrusions 64 as shown in FIG. 7 which slidably accepts the first and second terminal shim ends 56 and 58 of wave springs 50 and 52 until firm mechanical contact is achieved between the shim ends 56 and 58 and the closed ends 63 of protrusions 64 of U-shaped receiving plate 60. The U-shaped plastic receiving clip 60 containing wave springs 50 and 52 are inserted into vacuity 54 where it is attached as by adhesive to the plain interior surfaces 53A and 53B of vacuity 54 in heel area of foamed polymeric material 4B' of shoe sole assembly 4'. The U-shaped plastic-receiving clip 60 is designed to have one pair of cylindrically shaped compression limiters 65 associated with each wave spring. One of the terminal ends of each of the compression limiters 65 being adhesively attached to each of the opposing inner surfaces of clip 60 at the diametrical centers of protrusions 64 by adhesive, as shown in FIG. 7. The U-shaped plastic receiving clip 60 of this second embodiment of the shoes of this invention could be replaced by two plastic plates containing protrusions for slidably accepting the shim ends of one or a multiplicity of wave springs. The vacuity 54 is sealed as shown in FIGS. 5 and 6 with extensionable plastic 69 which provide for strength of the SCS 2' in the lateral or side to side direction during use.

Vacuity 66 is located in the metatarsal region of shoe sole assembly 4'. Plastic plates 68 and 70 having protrusions 72 substantially identical to protrusions 64 of FIG. 7 on their first surface into which the first and second shim ends 73A and 73B of wave springs 73 and the first and second shim ends 74A and 74B (not shown) of wave spring 74 (FIG. 6) are slidably inserted. The plastic plates 68 and 70, in addition to the first surfaces, have substantially parallel second surfaces. The assembled unit consisting of plastic plates 68 and 70, protrusions 72 and wave springs 73 and 74 are inserted into vacuity 66 of shoe sole assembly 4'. The second surfaces of plastic plates 68 and 70, with wave springs 73 and 74 inserted therebetween, are attached to the plain interior surfaces 75A and 75B of vacuity 66 by adhesive. The plates 68 and 70 are designed to accept with minimal resistance compression limiters 78 which are attached to diametrical centers of plates 68 and 70 in a manner similar to that of compression limiters 65 to plates 68 and 70. The compression limiters 78 serve to limit the amount of compression that wave springs 73 and 74 can undergo during use. The vacuity 66 is sealed with extesionable plastic 76.

It should be obvious to a person of ordinary skill in the art that more than two wave springs could be employed in each of the heel and metatarsal regions the shoes of this invention. A compression limiter, in this second embodiment, is associated with each wave spring. However, one or more strategically positioned pairs of regional compression limiters could be used to limit the compression of a plurality wave springs.

The spring-cushioned shoe of the second embodiment of this invention contains opposing plates, which are separated by intervening foam material shown in FIG. 5. The plastic plates could also be held firmly by friction or other mechanical means other than the previous mentioned adhesive, for slidable insertion into, and removal from, the shoe sole assembly 4' to accommodate replacing the wave springs with other wave springs of different spring rates. Furthermore, the plastic plates could be concatenated giving rise to a plastic member that extends from the heel area to the ball of the foot area of the shoe sole assembly. A shoe sole assembly designed to accept the plastic member could be equipped with a single vacuity that like the plastic member that extends the full length of the shoe sole assembly.

The wave springs used in the preferred embodiment of the invention are made of spring steel with inner and outer diameters, transverse thicknesses, peak and trough heights and quantities chosen so as to provide spring rates for wave spring 15 and 19 of 600 lb/in and 500 lb/in respectively.

The critical design parameters and materials of the wave springs could be selected so as to provide springs of different spring forces and other characteristics. For example, other metallic and non-metallic materials, polymers, and composites could be selected for different weight and strength characteristics. Also, the design parameters of the wave springs may be altered to provide varying strength, deflection, and load characteristics. Further, the embodiment of this invention is described in terms of a single cushion shoe. It should be obvious that the companion cushion shoe will be of identical design and construction.

The operation of the SCS 2 will now be explained in view of the shoe of FIG. 1. When a pair of spring cushioned shoes is placed in use by a user, for example a runner, the region of the shoe containing wave spring 15 strikes the running surface first. The strike force applied by the calcaneus portion of the foot compresses the wave spring to a prescribed height before the foot is brought to rest and the body mass is dynamically transferred to the metatarsal region of the foot in contact with the surface where the wave spring 19 becomes compressed. When the body mass is transferred to the metatarsal region of the foot, wave spring 15 which was in the initial footstrike undergoes a compress—recoil cycle. As the user lifts the metatarsal region of the foot, energy is transferred to this region as wave spring 19 recoils. Thus, wave springs 15 and 19 both provide cushioning and energy return to the user of the SCS 2.

During footstrike (whether from jumping or running), peak forces of several times the body weight can be imparted to the wave springs. We can assume that an average user of the shoes would weigh 165 lbs. Therefore, average peak forces greater than 300 $lb_f$ can be imparted to the wave springs. Hence, the previous mentioned spring rates could be used for a 165-lb person.

Wave springs are ideal for use in this limited space application. Conventional spring methods are inferior in shoe cushioning applications because of the limited combination of force, deflection, and space requirements.

While a preferred embodiment has been shown and described, it will be understood that it is not intended to limit the disclosure, but rather it is intended to cover all modifications and alternate methods falling within the spirit and the scope of the invention as defined in the appended claims.

What is claimed is:

1. A sole assembly for an article of footwear, the sole assembly having a heel region and a ball region, and the sole assembly comprising:

a first wave spring disposed within the heel region;

a second wave spring disposed within the ball region;

a first vacuity in the heel region and a second vacuity in the ball region, wherein the first wave spring is disposed within the first vacuity, and the second wave spring is disposed within the second vacuity; and a receiving clip disposed within the first vacuity, the receiving clip having a rigid upper internal surface and a rigid lower internal surface, the upper and lower internal surfaces each including a protrusion that defines a groove, wherein the first wave spring has an upper and a lower terminal shim end, and the first wave spring is disposed within the receiving clip such that its upper terminal shim end is disposed within the groove of the upper internal surface, and its lower terminal shim end is disposed within the groove of the lower internal surface.

2. The sole assembly of claim 1, wherein the receiving clip further comprises a pair of opposed spring compression limiters attached to the upper and lower internal surfaces respectively, the spring compression limiters engaging upper and lower sides of the wave spring respectively.

3. The sole assembly of claim 2, wherein the spring compression limiters are generally cylindrically shaped.

4. The sole assembly of claim 1, wherein the clip is U-shaped.

5. A sole assembly for an article of footwear, the sole assembly having a heel region and a ball region, and the sole assembly comprising:

a first wave spring disposed within the heel region;

a second wave spring disposed within the ball region;

a first vacuity in the heel region and a second vacuity in the ball region, wherein the first wave spring is disposed within the first vacuity, and the second wave spring is disposed within the second vacuity; and upper and a lower plastic plates disposed within the first vacuity, on opposite sides of the vacuity, each plate comprising a protrusion that defines a groove, wherein the first wave spring has an upper and a lower terminal shim end, and the first wave spring is disposed between the plates such that its upper terminal shim end is disposed within the groove of the upper plate, and its lower terminal shim end is disposed within the groove of the lower plate.

6. The sole assembly of claim 5, further comprising a pair of opposed spring compression limiters attached to the upper and lower plates respectively, the spring compression limiters engaging upper and lower sides of the wave spring respectively.

7. A sole assembly for an article of footwear, the sole assembly having a heel region and a ball region, and the sole assembly comprising:

a first wave spring disposed within the heel region;

a second wave spring disposed within the ball region;

a first vacuity in the heel region and a second vacuity in the ball region, wherein the first wave spring is disposed within the first vacuity, and the second wave spring is disposed within the second vacuity; and upper and lower plates disposed within the first vacuity, on opposite sides of the vacuity, wherein the first wave spring is disposed between the upper and lower plates, and wherein the upper and lower plates each comprise a projection extending from a plane of the plate, and wherein the first wave spring has an upper and a lower end, and the first wave spring is disposed between the plates such that its upper end fits around the projection of the upper plate, and its lower end fits around the projection of the lower plate.

8. The sole assembly of claim 7, wherein the projections extending from the upper and lower plates are generally circular in shape.

9. The sole assembly of claim 7, wherein the upper and lower ends of the first wave spring are terminal shim ends.

* * * * *